US011648425B2

(12) United States Patent
Wen et al.

(10) Patent No.: US 11,648,425 B2
(45) Date of Patent: May 16, 2023

(54) CHEMICAL OXYGEN SELF-RESCUE DEVICE

(71) Applicant: Shaanxi Star Explosion Safety Polytron Technologies Inc, Shaanxi (CN)

(72) Inventors: Xinguo Wen, Shaanxi (CN); Xiaowei Liu, Shaanxi (CN); Long Zhang, Shaanxi (CN); Hao Ding, Shaanxi (CN); Zhi Li, Shaanxi (CN)

(73) Assignee: Shaanxi Star Explosion Safety Polytron Technologies Inc, Shaanxi (CN)

( * ) Notice: Subject to any disclaimer, the term of this patent is extended or adjusted under 35 U.S.C. 154(b) by 559 days.

(21) Appl. No.: 16/759,457

(22) PCT Filed: Oct. 25, 2018

(86) PCT No.: PCT/CN2018/111920
§ 371 (c)(1),
(2) Date: Apr. 27, 2020

(87) PCT Pub. No.: WO2019/128429
PCT Pub. Date: Jul. 4, 2019

(65) Prior Publication Data

US 2020/0338371 A1 Oct. 29, 2020
US 2020/0338371 A1 Oct. 29, 2020

(30) Foreign Application Priority Data

Dec. 29, 2017 (CN) ..... 201711482226.X

(51) Int. Cl.
*A62B 7/08* (2006.01)
*A62B 9/02* (2006.01)
(Continued)

(52) U.S. Cl.
CPC ..... *A62B 7/08* (2013.01); *A62B 9/022* (2013.01); *A62B 9/04* (2013.01); *A62B 21/00* (2013.01)

(58) Field of Classification Search
CPC ..... A62B 7/08; A62B 19/00; A62B 19/02; A62B 9/003; A62B 9/02; A62B 9/04; A62B 9/06; A62B 9/022; A62B 21/00
See application file for complete search history.

(56) References Cited

U.S. PATENT DOCUMENTS 2,507,450 A * 5/1950 Millikan ..... A62B 7/08 128/202.26
3,650,269 A 3/1972 Curtis
(Continued)

FOREIGN PATENT DOCUMENTS

CN 85201623 U 3/1986
CN 85103668 A 11/1986
(Continued)

*Primary Examiner* — Valerie L Woodward
(74) *Attorney, Agent, or Firm* — Bret E. Field; Bozicevic, Field & Francis LLP

(57) ABSTRACT

Disclosed is a chemical oxygen self-rescue device, including a breathing assembly (1), an oxygen generating assembly (2) and a gas bag; (3) the oxygen generating assembly includes an oxygen generating agent tank (21), a gas discharge valve (23) and an oxygen candle (22); the gas discharge valve is arranged on a component above an oxygen generating agent (213) in the oxygen generating agent tank and below a breathing end of the breathing assembly, and the opening and closing of the gas discharge valve are controlled by means of an inflated volume of the gas bag. The chemical oxygen self-rescue device reduces the resistance to breathing, lowers the temperature of breathed gas and improves the utilization rate of the oxygen generating agent.

9 Claims, 5 Drawing Sheets

(51) Int. Cl.
*A62B 9/04* (2006.01)
*A62B 21/00* (2006.01)

(56) References Cited

U.S. PATENT DOCUMENTS

| | | | | | |
|---|---|---|---|---|---|
| 3,942,524 | A * | 3/1976 | Li | A62B 7/08 | 128/202.26 |
| 4,515,156 | A * | 5/1985 | Khudosovtsev | A62B 21/00 | 128/202.26 |
| 5,222,479 | A * | 6/1993 | Brauer | A62B 7/08 | 128/205.12 |
| 5,690,099 | A | 11/1997 | Abramov et al. | | |
| 2008/0276934 | A1* | 11/2008 | Kruger | A62B 7/08 | 128/204.15 |
| 2018/0140874 | A1* | 5/2018 | Schuler | A62B 7/08 | |

FOREIGN PATENT DOCUMENTS

| | | | |
|---|---|---|---|
| CN | 202140113 | U | 2/2012 |
| CN | 103301584 | A | 9/2013 |
| CN | 103405861 | A | 11/2013 |
| CN | 104436456 | A | 3/2015 |
| CN | 206261955 | U | 6/2017 |
| CN | 107998528 | A | 5/2018 |
| CN | 108211151 | A | 6/2018 |
| GB | 1443663 | A | 7/1976 |
| RU | 1677895 | A1 | 7/1997 |

* cited by examiner

CHEMICAL OXYGEN SELF-RESCUE DEVICE

FIELD OF THE INVENTION

The present invention relates to a safety device for coal mine, and in particular, to a chemical oxygen self-rescue device.

BACKGROUND OF THE INVENTION

Self-rescue device products are approximately divided into two types: reciprocating structure and cycling structure.

In the reciprocating structure, the breathing gas inlet and outlet are both breathing hoses. The gas bag is located on the bottom of the agent tank, the gas discharge valve is generally located on the gas bag, and the breathing gas passes through the agent tank twice. The air flow passes through the agent tank twice, so that the water vapour blown to the substratum of the agent can return to supertratum, the water vapour can be uniformly distributed in the agent tank and agglomeration can be alleviated, the rising of breathing resistance can be moderated, oxygen can be released uniformly, and the utilization rate of oxygen can be improved. However, because the breathing gas all passes through the agent tank, the inspired gas is also heated and the temperature of the breathing gas is high, thus the reaction rate is accelerated, and the oxygen content is increased. The discharge mode is gas bag discharge mode, the oxygen content of the gas discharged is high, and utilization rate of the agent is lowered.

In the cycling structure, the expired gas reaches the agent tank via the expiration hose. The gas bag is an overhead-type gas bag and the expiration hose is located in the gas bag. When the gas bag expands to a certain degree, the gas discharge valve is driven to open, and the gas in the gas bag is directly inspired, and the breathing gas passes through the agent tank once. In this structure, the expired gas enters the oxygen generating agent tank in one direction and reacts with the oxygen generating agent. At this moment, the water vapour in the expired gas is blown to and gathered on the bottom of the agent tank, which causes serious agglomeration of the substratum agent, so that the expiration resistance rises dramatically in the late stage of the protective time, and the amount of oxygen released in the early stage is higher than that in the late stage, thus the utilization rate of oxygen will be lowered. Because the air flow only passes through the agent layer once, the $CO_2$ is not absorbed thoroughly.

During the development of the chemical oxygen self-rescue device, it has been proved by a large number of tests and investigations that, compared with the cycling structure, the reciprocating structure has significant advantages in the utilization rate of the agent and the resistance, etc. However, in the reciprocating structure, the gas discharge valve is often located on the gas bag, and during discharging, a majority of the gas components is oxygen, thus the reaction rate will be accelerated, and the utilization rate of the agent will be lowered, and as a result, the breathing temperature will rise. In order to reach the nominal protective time, the amount of agent must be increased, thus the cost is added.

SUMMARY OF THE INVENTION

Therefore, it is an object of the present invention to provide a chemical oxygen self-rescue device, thereby reducing breathing resistance, lowering the temperature of breathed gas and improving the utilization rate of the oxygen generating agent.

To attain the above object, the invention provides a chemical oxygen self-rescue device, which comprises a breathing assembly, an oxygen generating assembly and a gas bag sequentially communicated with each other, wherein the oxygen generating assembly comprises an oxygen generating agent tank, a gas discharge valve and an oxygen candle, the gas discharge valve is arranged on a component above the oxygen generating agent in the oxygen generating agent tank and below a breathing end of the breathing assembly, and the opening and closing of the gas discharge valve are controlled by an inflated volume of the gas bag.

A heat radiation assembly and an oxygen generating agent are provided in the oxygen generating agent tank, wherein the heat radiation assembly communicates the breathing assembly and the oxygen generating agent tank, and the heat radiation assembly divides the oxygen generating agent tank into a plurality of accommodation spaces for loading the oxygen generating agent while filtering and cooling the gas in the oxygen generating agent tank.

The heat radiation assembly comprises a vent pipe and a heat radiation frame, wherein the vent pipe communicates the breathing assembly with the oxygen generating agent tank, the heat radiation frame is provided in the oxygen generating agent tank, and the oxygen generating agent tank is divided, by the vent pipe and the heat radiation frame, into a plurality of accommodation spaces for loading the oxygen generating agent.

Optionally, the gas discharge valve comprises a valve body and a valve core, wherein the valve body communicates the oxygen generating agent tank with the atmosphere, the valve core is provided in the valve body, one end of the valve core blocks an end of the valve body communicating with the atmosphere, and the blocking area of the valve core is less than the cross-sectional area of the valve body, and the other end of the valve core is connected with the gas bag.

Optionally, the gas discharge valve comprises a valve body, a valve core, a valve seat, a spring and a valve core pull-cord, wherein the valve body communicates the oxygen generating agent tank with the atmosphere, the valve seat is movably provided in the valve body, the valve core is restricted on the valve seat by the spring for blocking the valve body, and the valve core is connected with the inner wall of the gas bag via the valve core pull-cord.

Optionally, the spring is a spiral spring with a diameter enlarging gradually from the end part of the valve body far away from the oxygen generating agent tank to the end part of the valve body close to the oxygen generating agent tank.

Optionally, the heat radiation frame comprises heat radiation plates at least provided crosswise, wherein the number of the heat radiation plates provided crosswise is at least two, and the intersection angle of adjacent heat radiation plates is 60~90°.

Optionally, the heat radiation plate comprises a ventilation limit frame, in which a plurality of heat radiation meshes are provided stackedly.

Optionally, the vent pipe comprises a connection pipe segment and a ventilation and heat-dissipation pipe segment provided from top to bottom, wherein the connection pipe segment is configured to connect the breathing assembly with the oxygen generating assembly, and the ventilation and heat-dissipation pipe segment is configured to filter and cool the gas passing through.

Optionally, the breathing assembly comprises a mouth piece, a mouth piece radiator and a breathing hose sequentially communicated with each other, wherein the mouth piece radiator comprises a first vent, a heat radiation body, a heat radiation assembly and a second vent, the first vent and the second vent are provided on the heat radiation body, the mouth piece radiator communicates with the mouth piece and the breathing hose via the first vent and the second vent, and the heat radiation assembly is embedded in the heat radiation body for cooling the gas passing through.

Optionally, the oxygen generating agent tank comprises a tank body, of which the cross section is an ellipse;

The sealing edge structure of the tank body comprises a tank body cavity wall, a sealing glue and a tank body bottom wall, wherein the edge of the tank body bottom wall covers the edge of the tank body cavity wall and curls toward the mounting end of the breathing assembly, and the sealing glue is provided on a contact surface between the edge of the tank body cavity wall and the edge of the tank body bottom wall.

By the above technical solutions, the chemical oxygen self-rescue device of the invention can reduce breathing resistance, lower the temperature of breathed gas and improve the utilization rate of the oxygen generating agent.

Other characteristics and advantages of the invention will be illustrated in detail below by specific embodiments.

BRIEF DESCRIPTION OF THE DRAWINGS

The drawings are given to provide a further understanding of the invention and form a part of the application to explain the invention together with the specific embodiments below, rather than limiting the scope of the invention. In the drawings.

Figure 1:
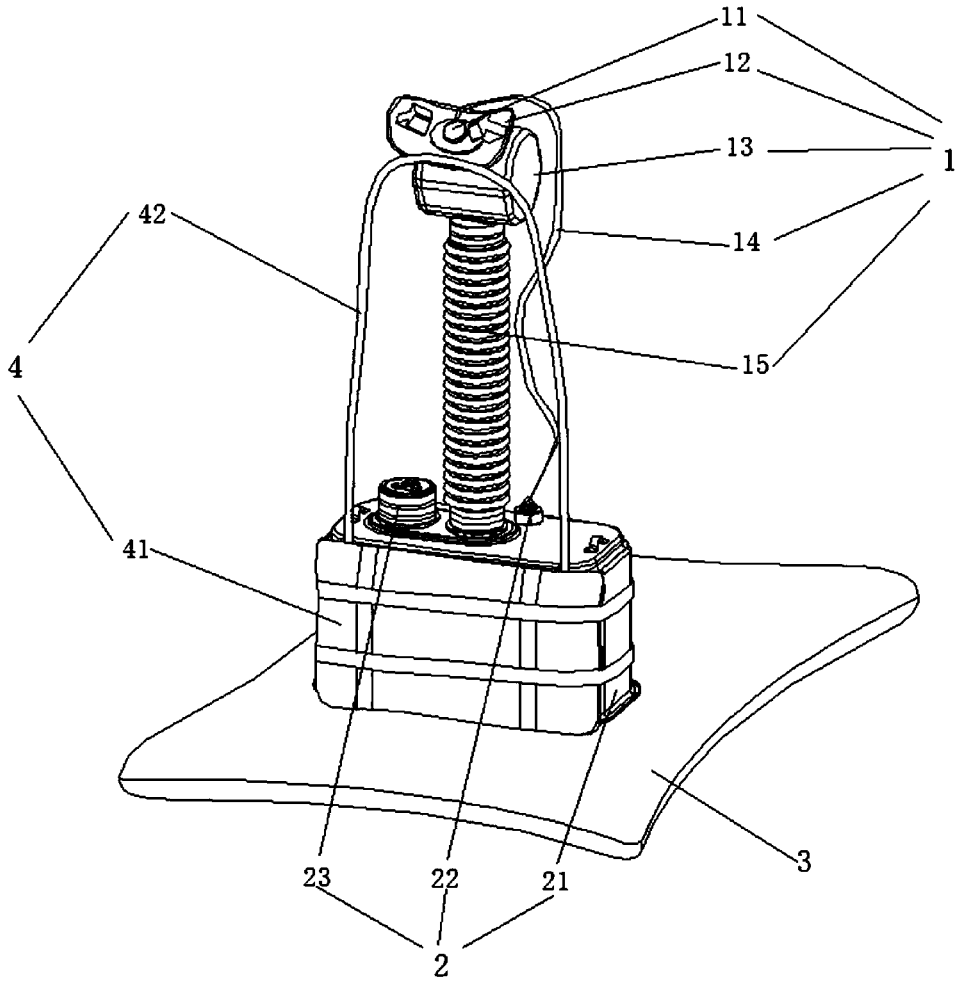
FIG. 1 is a structural representation of a chemical oxygen self-rescue device according to the invention.

Reference numerals in the drawings: 1: breathing assembly, 11: mouth piece plug, 12: mouth piece, 13: mouth piece radiator, 131: first vent, 132: heat radiation body, 133: heat radiation assembly, 134: second vent, 135: light reflecting plate, 14: oxygen candle connecting line, 15: breathing hose;

2: oxygen generating assembly, 21: oxygen generating agent tank, 211: vent pipe, 2111: connection pipe segment, 2112: ventilation and heat-dissipation pipe segment, 212: heat radiation frame, 2121: first heat radiation plate, 2122: second heat radiation plate, a: ventilation limit frame, b: heat radiation mesh, 213: oxygen generating agent, 214: gas bag connecting piece, 215: tank body, 2151: tank body cavity wall, 2152: sealing glue, 2153: tank body bottom wall, 22: oxygen candle, 23: gas discharge valve, 231: valve body, 232: valve seat, 233: spring, 234: valve core, 235: clamp, 236: rubber cover, 237: valve core pull-cord;

3: gas bag;

4: wearable heat-insulating assembly, 41: heat-insulating pad, 42: wearable belt.

DETAILED DESCRIPTION OF THE EMBODIMENTS

Specific embodiments of the invention will be illustrated in detail below in conjunction with the drawings. It should be understood that, the specific embodiments described herein are merely provided for illustrating and explaining the invention, rather than limiting the scope of the invention.

In the invention, when no reversed illustration is given, the orientations used, for example, "above" and "below", are generally defined by taking the map face of the corresponding drawings as a reference; "inner" and "outer" generally refer to the inner and outer of the outline of the corresponding component; "far" and "near" are defined by taking the map face of the corresponding drawings as a reference. "Cross-sectional area" is generally obtained by transecting along a transversally vertical direction taking the map face of the corresponding drawings as a reference.

As shown in FIG. 1, a chemical oxygen self-rescue device according to the invention includes a breathing assembly 1, an oxygen generating assembly 2 and a gas bag 3 sequentially communicated with each other. The oxygen generating assembly 2 includes an oxygen generating agent tank 21, a gas discharge valve 23 and an oxygen candle 22. The gas discharge valve 23 is arranged on a component above the oxygen generating agent in the oxygen generating agent tank 21 and below the breathing end of the breathing assembly 1. The gas discharge valve 23 is configured to discharge the extra gas in the gas circulating system of the self-rescue device and/or the excessive oxygen generated in by the oxygen generating agent tank into the atmosphere. For example, the gas discharge valve 23 may be provided on the breathing hose 15 of the breathing assembly 1 or at the connecting part between the breathing hose 15 and the oxygen generating agent tank 21. More preferably, the gas discharge valve 23 is provided on the upper wall of the oxygen generating agent tank 21. The discharge effect of the gas discharge valve may be realized so long as it is provided on a component above the oxygen generating agent in the oxygen generating agent tank 21 and below the breathing end of the breathing assembly 1. A majority of the gas component discharged by a gas discharge valve provided at this position is $CO_2$, and the content of oxygen newly generated is low, thus in the case of limited amount of gas discharged, the oxygen generated by the oxygen generating agent can be saved, the utilization rate of the agent can be increased, and the oxygen generating reaction will not be too fierce. At the same time, it is favorable to lower the temperature of breathed gas. For example, the gas discharge valve directly communicates with the oxygen generating agent tank, and during reaction, the temperature of the agent tank is high, and a high-temperature gas will be brought during discharging, thus the temperature of the agent tank will be lowered. The valve core of the gas discharge valve may be connected with the wall of the gas bag via a soft component, for example, a cord, a rubber rope and a soft metal wire, etc. The gas bag will expand when receiving the gas breathed by a human body and the gas generated by the oxygen generating agent tank, and a certain travelling distance away from the oxygen generating assembly will be formed after expansion, so that the valve core of the gas discharge valve may be pulled, thereby realizing the opening and closing of the gas discharge valve.

Figure 3:
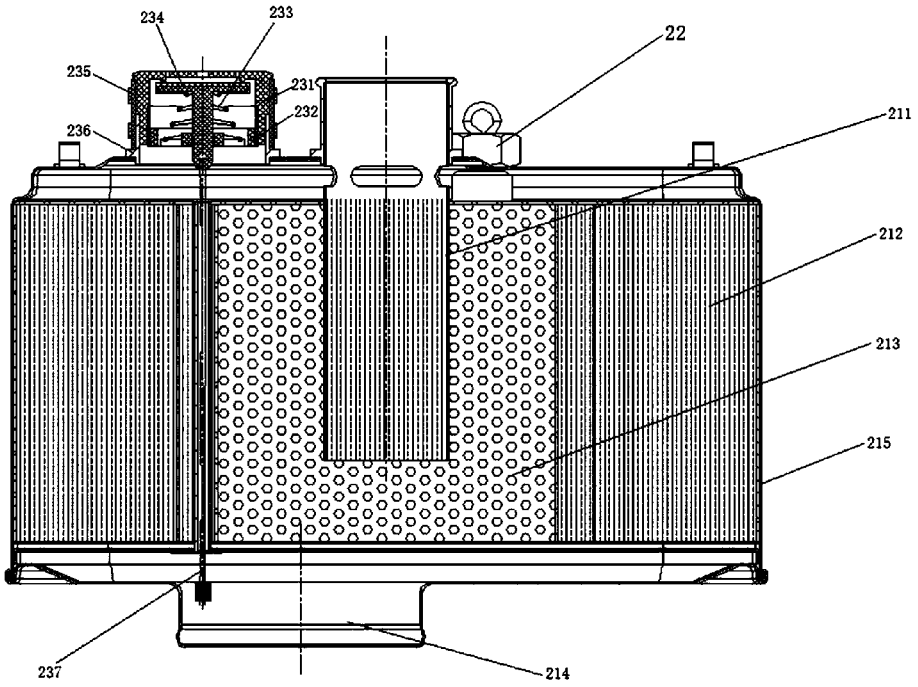
FIG. 3 is a sectional structural representation of the oxygen generating agent tank of the chemical oxygen self-rescue device according to the invention.

As shown in FIG. 3, in an embodiment of the invention, a heat radiation assembly and an oxygen generating agent 213 are provided in the oxygen generating agent tank 21. The heat radiation assembly includes a vent pipe 211 and a heat radiation frame 212. The vent pipe 211 communicates with the breathing assembly 1 and the oxygen generating agent tank 21. The heat radiation frame 212 is provided in the oxygen generating agent tank 21. The vent pipe 211 and the heat radiation frame 212 divide the oxygen generating agent tank 21 into a plurality of accommodation spaces for loading the oxygen generating agent 213. A gas bag connecting piece 214 is provided on the bottom of the oxygen generating agent tank 21 for connecting the oxygen generating agent tank 21 with the gas bag 3. For example, the vent pipe 211 is embedded in the oxygen generating agent tank 21, the heat radiation frame 212 is placed in the oxygen generating agent tank 21, and the spaces formed by the vent pipe 211 and the heat radiation frame 212 in the oxygen generating agent tank 21 may all be configured to fill the oxygen generating agent 213, for example, potassium superoxide tablets, which is configured to produce oxygen. The embedded part of the vent pipe 211 is configured to connect the breathing assembly 1 with the oxygen generating assembly 2, and the other part may also be filled with filter-mesh-type heat radiation wires for further lowering the gas temperature and filtering the gas. The coordination of the vent pipe 211 and the heat radiation frame 212 reasonably utilize the space in the oxygen generating agent tank 21, so that the heat radiation assembly occupies as little space as possible, and more space can be provided for the oxygen generating agent 213, and hence the operation requirements can be guaranteed. At the same time, a breathing gas having a lower temperature and filtered more thoroughly can be provided. By the coordination of the heat radiation assembly and the gas discharge valve 23, in the use of the self-rescue device of the invention, the heat radiation assembly will first emit a certain amount of heat, and the reaction rate of the oxygen generating agent in the late stage may also be lowered due to the heat, $CO_2$ and water vapour carried over by discharge, thus the heat emitted in the reaction can be lowered.

In conjunction with FIG. 3, in an embodiment of the invention, the gas discharge valve 23 includes a valve body 231 and a valve core 234. The valve body 231 communicates the oxygen generating agent tank 21 with the atmosphere. The valve core 234 is provided in the valve body 231, one end of the valve core 234 blocks the valve body 231, and the other end of the valve core 234 is connected with the gas bag 3. For example, the valve body 231 is a cylindrical housing member, one end of the valve body 231 is an open end communicating with the oxygen generating agent tank 21, and the other end of the valve body 231 is opened with a vent of a certain size for communicating with the atmosphere. The valve core 234 can block the end face of the end of the valve body 231 communicating with the atmosphere, and the blocking area is smaller than the cross-sectional area of the valve body 231. The other end of the valve core 234 is connected with the wall of the gas bag via a soft component, for example, a cord, a rubber rope or a soft metal wire, etc. On receiving the gas breathed by a human body and the gas produced by the oxygen generating agent tank 21, the gas bag 3 will expand, and a certain travelling distance away from the oxygen generating assembly will be formed after expansion, so that the valve core 234 of the gas discharge valve 23 will be pulled, thereby realizing the opening and closing of the gas discharge valve 23.

For example, in a feasible preferred embodiment, the gas discharge valve 23 includes a valve body 231, a valve core 234, a valve seat 232, a spring 233 and a valve core pull-cord 237. The valve body 231 communicates the oxygen generating agent tank 21 with the atmosphere. The valve seat 232 is movably provided in the valve body 231. For example, the valve seat 232 may be connected with the valve body 231 via screw thread, thus the location of the valve seat 232 in the valve body 231 may be adjusted, and hence the degree the spring 233 rests against the valve core 234 may be adjusted. For example, the working effect of the gas discharge valve 23 may be adjusted by adjusting the screw pitch and amount of compression, etc., of the spring 233 so as to meet the requirement of different venting degrees of the agent tank. The valve core 234 is restricted on the valve seat 232 by the spring 233 for blocking the valve body 231, and the valve core 234 is connected with the inner wall of the gas bag 3 via the valve core pull-cord 237. For example, the valve body 231 is a cylindrical housing member. An annular rubber cover 236 is first provided at the connecting part between the valve body 231 and the tank body 215, the valve body 231 is socketed onto the rubber cover 236 and fixed by a clamp 235. The cross-sectional area of the part at which the valve body 231 communicates with the oxygen generating agent tank 21 is larger than the cross-sectional area of the part at which the valve body 231 communicates with the atmosphere, and the area blocked by the valve core 234 at the part where the valve body 231 communicates with the atmosphere is less than the cross-sectional area of the valve body 231 and is larger than the cross-sectional area of the part at which the valve body 231 communicates with the atmosphere. For example, the shape of the longitudinal section of the valve core 234 is similar to "T". That is, the upper part of the valve core 234 is a discoid plugging body, and lower part of the valve core 234 is a columnar connecting body. The upper part of the valve core 234 blocks the part at which the valve body 231 communicates with the atmosphere, and the lower part of the valve core 234 passes through the valve seat 232 and is connected with the gas bag 3 via the valve core pull-cord 237. Preferably, the valve core pull-cord 237 passes through the oxygen generating agent tank 21 and is connected with the gas bag 3. In such a internal passing mode, it may be avoided that the valve body is opened accidentally due to external factors and interferences; instead, the opening and closing of the gas discharge valve can only be controlled by the expanding of the gas bag 3.

Preferably, the spring 233 is a spiral spring with a diameter enlarging gradually from the end part of the valve body 231 far away from the oxygen generating agent tank 21 to the end part of the valve body 231 close to the oxygen generating agent tank 21. Because the valve core 234 is connected to a soft valve core pull-cord 237, the displacement angle of the valve core 234 may deviate during drawing, so that the drawing movement of the valve core 234 may be not smooth. Therefore, it is preferred that the spring 233 used is a tower-shaped spiral spring shown in FIG. 3, which may function to correct the movement of the valve core 234.

Figure 5:
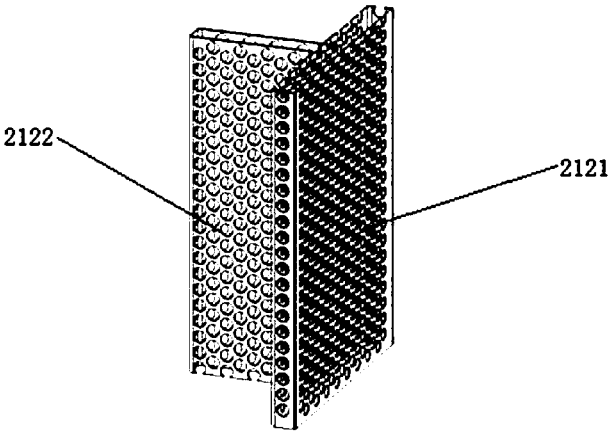
FIG. 5 is a structural representation of a heat radiation frame of the chemical oxygen self-rescue device according to the invention.
Figure 6:
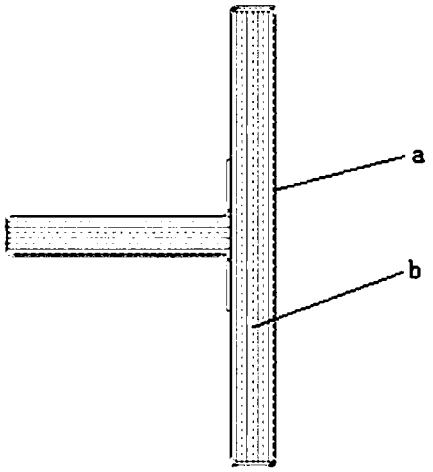
FIG. 6 is a sectional structural representation of the heat radiation frame of the chemical oxygen self-rescue device according to the invention.

As shown in FIGS. 5 and 6, the heat radiation frame 212 includes heat radiation plates provided crosswise at least, the number of the heat radiation plates provided crosswise is at least two, and the intersection angle of adjacent heat radiation plates is 60°~90°. For example, the heat radiation plates provided crosswise may be a T-shaped frame consisting of a first heat radiation plate 2121 and a second heat radiation plate 2122 vertical to each other, and it may also be a cross-type frame, or two plates arranged at a certain angle. Moreover, for example, it may be a heat radiation frame consisting of three or more plates provided crosswise. However, if the number of plates is too large, excessive space in the oxygen generating agent tank will be occupied, thus the space for placing the oxygen generating agent will be reduced. Therefore, the optimal arrangement mode is the T-shaped frame provided in FIGS. 5 and 6. The T-shaped frame may be arranged in the oxygen generating agent tank as follows: after being laid down, the horizontal beam is placed toward the direction of the vent pipe 211, and the vertical beam is placed toward the side wall of the oxygen generating agent tank 21; more preferably, the vent pipe 211 is embedded at the center of the upper wall of the oxygen generating agent tank 21, a heat radiation frame 212 is arranged respectively in the oxygen generating agent tank at the two ends of the vent pipe 211, and the oxygen generating agent tank is divided by the vent pipe 211 and the two heat radiation frames 212 into 5 independent spaces, wherein each space is filled with the oxygen generating agent 213 as required by the amount of oxygen to be produced.

Preferably, in an embodiment of the invention, the heat radiation plate includes a ventilation limit frame a, and a plurality of heat radiation meshes b are provided stackedly in the ventilation limit frame a. For example, the ventilation limit frame a is a plate frame on which through holes are provided uniformly, the plate frame is filled with a mesh structure. On one hand, the plate frame restricts and loads the loose heat radiation mesh and thus defines the structure of the heat radiation frame 212; on the other hand, it may be adjusted flexibly according to the space arrangement in the oxygen generating agent tank 21, thus it may be guaranteed that each corner is filled with the heat radiation frame 212 for cooling the air passing through. The filter mesh plays the role of heat radiation and guiding, and the whole system functions to guide the air flow, lower the reaction rate and lower the temperature of the agent tank, etc. The structure has good consistency, a simple and effective structure and an excellent control effect.

Figure 7:
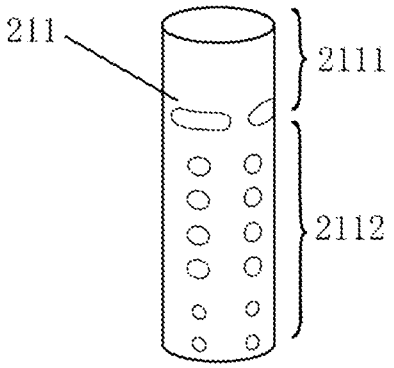
FIG. 7 is a structural representation of a vent pipe of the chemical oxygen self-rescue device according to the invention.

As shown in FIG. 7, in an embodiment of the invention, the vent pipe 211 includes a connection pipe segment 2111 and ventilation and heat-dissipation pipe segment 2112 provided from top to bottom. The connection pipe segment 2111 is configured to connect the breathing assembly 1 with the oxygen generating assembly 2, and the ventilation and heat-dissipation pipe segment 2112 is configured to filter and cool the gas passing through. For example, the connection pipe segment 2111 is a common pipe for connecting the breathing hose 15 on the breathing assembly 1 to the oxygen generating agent tank 21 on the oxygen generating assembly 2, and the ventilation and heat-dissipation pipe segment 2112 is a pipe structure with through holes provided uniformly on the tube wall thereof, and it may be filled with a heat radiation mesh b the same as that in the heat radiation frame 212 for further lowering the gas temperature and filtering the gas.

Figure 4:
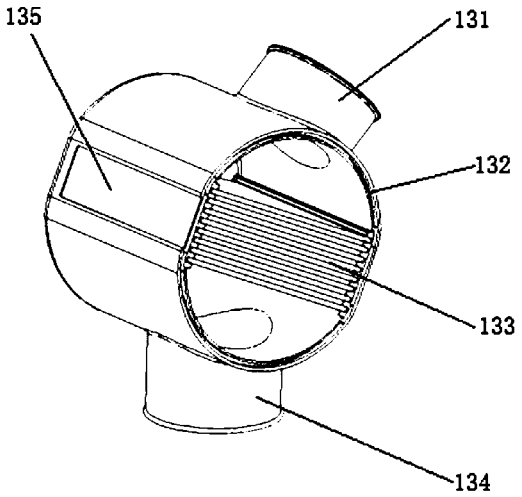
FIG. 4 is a structural representation of a mouth piece radiator of the chemical oxygen self-rescue device according to the invention.

As shown in FIG. 1 and FIG. 4, in an embodiment of the invention, the breathing assembly 1 includes a mouth piece 12, a mouth piece radiator 13 and a breathing hose 15 sequentially communicated with each other. The mouth piece 12 is plugged with a mouth piece plug 11, and the mouth piece plug 11 is connected with an oxygen candle connecting line 14 for opening the oxygen candle. The mouth piece radiator 13 includes a first vent 131, a heat radiation body 132, a heat radiation assembly 133 and a second vent 134. The first vent 131 and the second vent 134 are provided on the heat radiation body 132. The mouth piece radiator 13 communicates with the mouth piece 12 and the breathing hose 15 via the first vent 131 and the second vent 132. The heat radiation assembly 133 is embedded in the heat radiation body 132 for cooling the gas passing through. For example, the heat radiation body 132 is an annular frame, in which the heat radiation assembly 133 is inserted. The heat radiation assembly 133 may a multi-layer wire mesh structure provided stackedly. On one hand, the temperature of the gas inspired may be lowered, and comfortability during wearing may be improved; and on the other hand, the temperature of the gas expired may be lowered, the reaction rate of the agent may be lowered, and the effective protective time of the product may be prolonged. Moreover, the breathing resistance may be reduced, and a smooth resistance may be ensured even if the breathing volume of a user is increased in the case of strenuous exercise. Additionally, the problem of wearing angle is considered, the first vent 131 and the second vent 134 are designed with a certain angle, which can guarantee that the breathing hose 15 is vertical to the tank body 215 and the gas path is unobstructed. The mouth piece radiator 13 is designed for lowering the temperature of the breathed gas, and the temperature of the inspired gas and the resistance to the expired gas and the inspired gas may be lowered greatly. The $KO_2$ powder may be prevented from entering the respiratory tract, and the effective protective time of the product may be prolonged.

Figure 2:
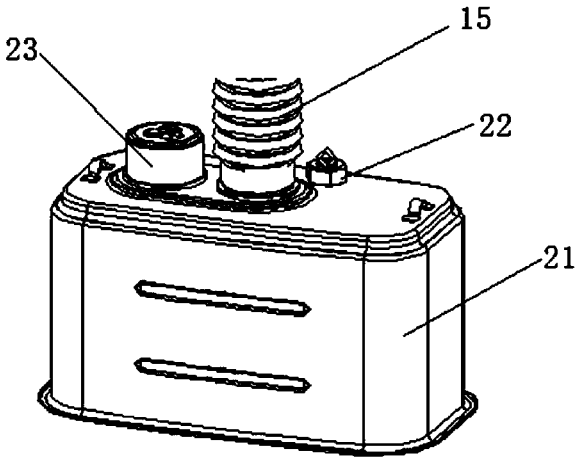
FIG. 2 is a structural representation of an oxygen generating agent tank of the chemical oxygen self-rescue device according to the invention.

As shown in FIG. 2, in an embodiment of the invention, the oxygen generating agent tank 21 includes a tank body 215, and the cross section of the tank body 215 is an ellipse. For the elliptical tank body, no mismachining tolerance caused by right angle side will appear during manufacturing, thus the volume stability of each oxygen generating agent tank can be guaranteed, which is favorable for the large-scale and highly-stable manufacturing of the chemical oxygen self-rescue device.

Figure 8:
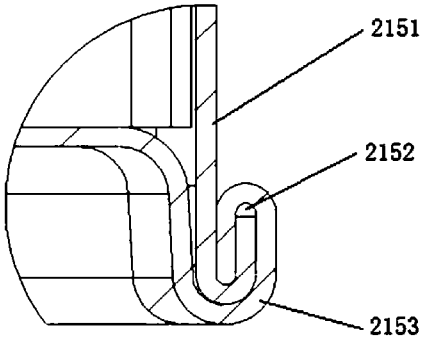
FIG. 8 is a structural representation of a tank body sealed edge of the chemical oxygen self-rescue device according to the invention.

As shown in FIG. 8, preferably, the sealing edge structure of the tank body 215 includes a tank body cavity wall 2151, a sealing glue 2152 and a tank body bottom wall 2153. The edge of the tank body bottom wall 2153 covers the edge of the tank body cavity wall 2151 and curls toward the mounting end of the breathing assembly 1. The sealing glue 2152 is provided on a contact surface between the edge of the tank body cavity wall 2151 and the edge of the tank body bottom wall 2153. In the traditional canning technology for the self-rescue device, a hydraulic press is employed for the pressfitting of the tank body and the tank cover, wherein the tank cover surrounds the flanged edge of the tank body, and the seam is sealed in a glue sealing mode. This mode has a poor sealing effect, and the curing time of the glue is long (24 h), which greatly limits the production efficiency of the products. Moreover, the colloid has certain flowability, thus the sealing surface will be inaesthetic. In order to solve this problem, in the invention, the sealing mode of the tank cover of a tear-off tin is used for reference, and this canning technology is introduced into the self-rescue device industry for the first time. This canning technology has the advantages of good sealing effect and high degree of automation, and a sealed tank body may directly enter the next process, thus the working efficiency may be greatly improved, and the surface has a good looking, with no glue marks.

Based on the above technical solutions, the chemical oxygen self-rescue device according to the invention can lower the breathing resistance of the product (the standard for breathing resistance is: under the condition of 35 L/min, the sum of the inspiration resistance and the expiration resistance should not exceed 13 mbar, and the maximum breathing resistance in the experiment should not exceed 7.5 mbar), lower the breathing temperature (in a relative humidity of 30%, the inspired gas temperature should not exceed +60° C.; and for the relative humidity exceeding 30%, the temperature should not exceed +50° C.), meet the corresponding protective performance (in the nominal protective time, the content of $CO_2$ in the inspired gas should not exceed 1.5%, and the maximum value should not exceed 3.0%) and be applicable for 30 min, 40 min, 50 min and 60 min self-rescue devices. The following shows the test data during R&D trial production. Performance tests are carried out on the chemical oxygen self-rescue device according to the invention, and the experimental results are shown by the experimental data in Table 1, Table 2, Table 3 and Table 4.

TABLE 1

Performance test result of 30 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 7:44 | 20.8 | 0.34 | 259 | −312 | 32.2 | 28.3 | 27.2 | 23.6 |
| 7:45 | 21.8 | 0.33 | 232 | −267 | 33.1 | 30.2 | 29 | 25.1 |
| 7:46 | 27 | 0.69 | 237 | −285 | 33.6 | 31.5 | 30.2 | 25.9 |
| 7:47 | 34.4 | 0.94 | 248 | −275 | 33.9 | 32.6 | 31.2 | 26.4 |
| 7:48 | 41.8 | 1.1 | 303 | −279 | 34.3 | 33.6 | 32 | 26.8 |
| 7:49 | 49.1 | 1.22 | 295 | −278 | 34.8 | 34.5 | 32.9 | 26.8 |
| 7:50 | 56.9 | 1.17 | 304 | −263 | 35.4 | 35.4 | 33.4 | 26.9 |
| 7:51 | 63.8 | 1.04 | 313 | −268 | 36.1 | 36 | 33.9 | 27.1 |
| 7:52 | 69.4 | 1.01 | 320 | −275 | 36.4 | 36.6 | 34.2 | 27.3 |
| 7:53 | 73.9 | 1.01 | 325 | −283 | 36.7 | 37 | 34.5 | 27.4 |
| 7:54 | 77.4 | 1.02 | 344 | −328 | 37.1 | 37.5 | 34.7 | 27.6 |
| 7:55 | 80.2 | 1.05 | 351 | −337 | 37.7 | 38 | 35.2 | 27.7 |
| 7:56 | 82.4 | 1.08 | 335 | −375 | 38.1 | 38.5 | 35.6 | 27.9 |
| 7:57 | 84.2 | 1.06 | 336 | −288 | 38.5 | 39.1 | 36 | 28.2 |
| 7:58 | 85.7 | 0.97 | 336 | −300 | 38.8 | 39.6 | 36.6 | 28.5 |
| 7:59 | 86.8 | 0.88 | 337 | −290 | 39.2 | 40.1 | 37 | 28.9 |
| 8:00 | 87.7 | 0.81 | 903 | −1252 | 42 | 43.6 | 40 | 29.5 |
| 8:01 | 88 | 0.82 | 1280 | −1095 | 43.3 | 45.9 | 42 | 31.2 |
| 8:02 | 88.3 | 1 | 893 | −947 | 44.2 | 47.4 | 43.3 | 32.4 |
| 8:03 | 88.9 | 1.03 | 891 | −963 | 45.1 | 48.6 | 44.4 | 33.3 |
| 8:04 | 89.1 | 1.02 | 890 | −969 | 45.7 | 49.9 | 45.2 | 34.1 |
| 8:05 | 89.1 | 1.01 | 887 | −978 | 43.3 | 47 | 43.5 | 34.8 |
| 8:06 | 89.4 | 0.94 | 335 | −314 | 42.8 | 46.2 | 43 | 34.8 |
| 8:07 | 89.7 | 0.74 | 324 | −323 | 42.9 | 46.1 | 43.1 | 34.5 |
| 8:08 | 89.6 | 0.66 | 318 | −326 | 43 | 46.2 | 43.1 | 34.3 |
| 8:09 | 89.3 | 0.65 | 315 | −333 | 43.2 | 46.3 | 43.1 | 34.5 |
| 8:10 | 88.9 | 0.65 | 314 | −332 | 43.2 | 46.4 | 43.3 | 34.4 |
| 8:11 | 88.4 | 0.68 | 386 | −339 | 43.2 | 46.4 | 43.5 | 34.5 |
| 8:12 | 88 | 0.72 | 346 | −368 | 43.3 | 46.6 | 43.7 | 34.5 |
| 8:13 | 87.5 | 0.76 | 320 | −396 | 43.3 | 46.7 | 43.9 | 34.7 |
| 8:14 | 87 | 0.8 | 314 | −439 | 43.6 | 47 | 44.1 | 34.8 |
| 8:15 | 86.5 | 0.82 | 316 | −356 | 43.7 | 47 | 44.4 | 35 |
| 8:16 | 85.9 | 0.85 | 315 | −361 | 43.8 | 47.2 | 44.7 | 35.3 |
| 8:17 | 85.2 | 0.91 | 316 | −365 | 43.8 | 47.4 | 44.9 | 35.6 |
| 8:18 | 84.3 | 1 | 383 | −372 | 43.8 | 47.4 | 45.1 | 36 |
| 8:19 | 83.3 | 1.11 | 364 | −374 | 44.1 | 47.7 | 45.4 | 36.2 |
| 8:20 | 82.2 | 1.23 | 319 | −377 | 44 | 47.7 | 45.6 | 36.6 |
| 8:21 | 80.9 | 1.4 | 319 | −380 | 44.3 | 47.8 | 45.9 | 36.9 |

TABLE 2

Performance test result of 40 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 14:56 | 20.6 | 0.04 | 232 | −246 | 27.1 | 25.1 | 23.8 | 24.6 |
| 14:57 | 20.9 | 0.26 | 244 | −253 | 29.2 | 27 | 25 | 24.2 |
| 14:58 | 23.3 | 0.52 | 233 | −254 | 30.5 | 28.6 | 26.5 | 24.7 |
| 14:59 | 29.6 | 0.86 | 256 | −258 | 31.2 | 29.8 | 27.5 | 25.4 |
| 15:00 | 36.9 | 1.06 | 266 | −258 | 31.9 | 31 | 28.2 | 25.7 |
| 15:01 | 43.3 | 1.17 | 307 | −244 | 32 | 31.8 | 29 | 26 |
| 15:02 | 49 | 1.27 | 653 | −244 | 32.4 | 32.7 | 29.4 | 26.1 |
| 15:03 | 55.2 | 1.32 | 515 | −240 | 32.6 | 33.3 | 30.1 | 26 |
| 15:04 | 62 | 1.26 | 386 | −239 | 32.9 | 34.1 | 30.8 | 26.2 |
| 15:05 | 67.7 | 1.17 | 391 | −239 | 33.1 | 34.7 | 31.3 | 26.4 |
| 15:06 | 72.1 | 1.13 | 392 | −264 | 33.3 | 35.3 | 32 | 26.7 |
| 15:07 | 75.6 | 1.12 | 392 | −291 | 33.7 | 36.1 | 32.8 | 26.9 |
| 15:08 | 78.3 | 1.12 | 393 | −336 | 34 | 36.5 | 33.3 | 27.4 |
| 15:09 | 80.4 | 1.12 | 444 | −367 | 34.5 | 37.1 | 34 | 27.6 |

TABLE 2-continued

Performance test result of 40 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 15:10 | 82.1 | 1.13 | 394 | −258 | 34.9 | 37.6 | 34.7 | 27.9 |
| 15:11 | 83.5 | 1.14 | 396 | −261 | 35.4 | 38.1 | 35.2 | 28.3 |
| 15:12 | 84.7 | 1.14 | 389 | −258 | 35.8 | 38.5 | 35.7 | 28.6 |
| 15:13 | 85.6 | 1.14 | 386 | −258 | 36.1 | 38.8 | 36.2 | 29 |
| 15:14 | 86.3 | 1.14 | 384 | −266 | 36.3 | 39.2 | 36.8 | 29 |
| 15:15 | 86.9 | 1.14 | 384 | −269 | 36.5 | 40.4 | 37.3 | 29.5 |
| 15:16 | 87.4 | 1.12 | 564 | −271 | 36.7 | 41 | 37.7 | 29.7 |
| 15:17 | 87.7 | 1.12 | 364 | −273 | 37.1 | 41.3 | 38.1 | 30.1 |
| 15:18 | 87.9 | 1.12 | 378 | −273 | 37.4 | 41.7 | 38.6 | 30.4 |
| 15:19 | 88.1 | 1.12 | 365 | −283 | 37.4 | 42.1 | 38.8 | 30.8 |
| 15:20 | 88.2 | 1.12 | 355 | −337 | 37.9 | 42.3 | 39.2 | 31.1 |
| 15:21 | 88.2 | 1.15 | 1171 | −1054 | 37.1 | 40.1 | 38.6 | 32.1 |
| 15:22 | 86.4 | 1.27 | 1125 | −1158 | 38.6 | 41.6 | 39.7 | 34.5 |
| 15:23 | 83.3 | 1.63 | 902 | −936 | 39.7 | 43.1 | 40.8 | 35.3 |
| 15:24 | 81.8 | 1.79 | 895 | −935 | 40.8 | 45 | 42.4 | 35.6 |
| 15:25 | 80.9 | 1.84 | 881 | −939 | 41.6 | 46.8 | 43.8 | 36 |
| 15:26 | 80 | 1.86 | 1062 | −959 | 42.8 | 48.8 | 45.2 | 36.5 |
| 15:27 | 79.3 | 1.92 | 308 | −332 | 41 | 45.6 | 43.1 | 36.9 |
| 15:28 | 79.8 | 1.86 | 359 | −325 | 41 | 45.4 | 42.9 | 36.7 |
| 15:29 | 80.2 | 1.57 | 332 | −326 | 41.1 | 45.6 | 42.8 | 36.7 |
| 15:30 | 80 | 1.48 | 298 | −329 | 41.4 | 45.8 | 43.1 | 36.5 |
| 15:31 | 79.4 | 1.5 | 292 | −335 | 41.3 | 46.1 | 43.3 | 36.5 |
| 15:32 | 78.5 | 1.6 | 294 | −335 | 41.5 | 46.4 | 43.5 | 36.3 |
| 15:33 | 77.6 | 1.72 | 293 | −340 | 42 | 46.6 | 43.5 | 36.3 |
| 15:34 | 76.5 | 1.83 | 292 | −364 | 42.1 | 46.7 | 43.8 | 36.3 |
| 15:35 | 75.5 | 1.95 | 351 | −416 | 42.3 | 47 | 43.8 | 36.4 |
| 15:36 | 74.4 | 2.06 | 311 | −426 | 42.2 | 47 | 44.1 | 36.5 |
| 15:37 | 73.3 | 2.17 | 287 | −342 | 42.2 | 47.2 | 44.3 | 36.7 |
| 15:38 | 72.2 | 2.27 | 290 | −345 | 42.3 | 47.4 | 44.4 | 36.7 |
| 15:39 | 71.2 | 2.37 | 289 | −347 | 42.5 | 47.4 | 44.6 | 36.8 |
| 15:40 | 70.1 | 2.47 | 289 | −344 | 42.5 | 47.4 | 44.7 | 36.7 |
| 15:41 | 68.9 | 2.56 | 303 | −348 | 42.5 | 47.4 | 44.9 | 37 |
| 15:42 | 67.8 | 2.64 | 327 | −345 | 42.4 | 47.5 | 45.1 | 37.2 |

TABLE 3

Performance test result of 50 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 14:01 | 22.9 | 0.05 | 261 | −276 | 27.2 | 24.5 | 24.2 | 23.1 |
| 14:02 | 51.5 | 0.35 | 320 | −264 | 30 | 26 | 25.4 | 22.8 |
| 14:03 | 31.3 | 0.78 | 350 | −290 | 31.4 | 27.4 | 26.6 | 23.4 |
| 14:04 | 30.3 | 1.07 | 450 | −302 | 32.2 | 28.6 | 28 | 24 |
| 14:05 | 36.2 | 1.11 | 260 | −278 | 32.7 | 29.8 | 29.1 | 24.6 |
| 14:06 | 42.4 | 1.1 | 310 | −253 | 33.3 | 31 | 30.1 | 25 |
| 14:07 | 48 | 1.15 | 372 | −244 | 33.8 | 32 | 31.3 | 25.5 |
| 14:08 | 53.4 | 1.18 | 465 | −267 | 33.8 | 32.5 | 31.6 | 25.8 |
| 14:09 | 58.8 | 1.12 | 612 | −275 | 34.2 | 33.6 | 32.6 | 26.1 |
| 14:10 | 64.6 | 1.04 | 458 | −259 | 34.5 | 34.2 | 33.3 | 26.4 |
| 14:11 | 69.7 | 0.97 | 379 | −268 | 34.5 | 34.5 | 33.9 | 26.8 |
| 14:12 | 74 | 0.92 | 372 | −262 | 34.7 | 35.3 | 34.4 | 27.1 |
| 14:13 | 77.4 | 0.91 | 340 | −258 | 34.9 | 35.8 | 35 | 27.4 |
| 14:14 | 80 | 0.91 | 338 | −269 | 35.4 | 36.3 | 35.7 | 27.9 |
| 14:15 | 82 | 0.91 | 345 | −267 | 35.4 | 36.7 | 36.1 | 28.1 |
| 14:16 | 83.6 | 0.91 | 382 | −284 | 35.4 | 37 | 36.5 | 28.3 |
| 14:17 | 85 | 0.88 | 346 | −314 | 35.4 | 37.5 | 36.8 | 28.7 |
| 14:18 | 86.1 | 0.88 | 350 | −346 | 35.5 | 37.8 | 37.2 | 29.1 |
| 14:19 | 87.1 | 0.87 | 354 | −374 | 35.8 | 38.2 | 37.7 | 29.4 |
| 14:20 | 87.9 | 0.85 | 355 | −299 | 35.9 | 38.6 | 38.1 | 29.9 |
| 14:21 | 88.6 | 0.8 | 353 | −273 | 36 | 38.8 | 38.6 | 30.2 |
| 14:22 | 89.1 | 0.77 | 356 | −275 | 36.2 | 39.2 | 38.9 | 30.7 |
| 14:23 | 89.5 | 0.78 | 421 | −275 | 36.3 | 39.5 | 39.2 | 31.1 |
| 14:24 | 89.7 | 0.77 | 348 | −277 | 36.3 | 39.6 | 39.5 | 31.3 |
| 14:25 | 89.9 | 0.79 | 348 | −279 | 36.5 | 39.7 | 39.7 | 31.7 |
| 14:26 | 90 | 0.82 | 346 | −282 | 36.9 | 40 | 40.1 | 32 |
| 14:27 | 90.1 | 0.84 | 342 | −287 | 37 | 40.4 | 40.4 | 32.4 |
| 14:28 | 90.1 | 0.86 | 344 | −288 | 37.1 | 40.6 | 40.6 | 32.6 |
| 14:29 | 90.1 | 0.87 | 360 | −288 | 37.2 | 40.7 | 40.8 | 32.7 |

TABLE 3-continued

Performance test result of 50 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 14:30 | 90 | 0.89 | 374 | −322 | 37.6 | 41 | 41 | 33.1 |
| 14:31 | 90 | 0.89 | 336 | −356 | 37.8 | 41 | 41.2 | 33.2 |
| 14:32 | 89.5 | 0.9 | 328 | −372 | 37.9 | 41.2 | 41.3 | 33.4 |
| 14:33 | 89 | 0.91 | 328 | −391 | 38.2 | 41.4 | 41.5 | 33.8 |
| 14:34 | 88.7 | 0.91 | 329 | −309 | 38.4 | 41.5 | 41.9 | 33.9 |
| 14:35 | 88.6 | 0.91 | 327 | −320 | 38.4 | 41.7 | 42 | 34.2 |
| 14:36 | 88.4 | 0.92 | 1160 | −941 | 40 | 45.5 | 45.3 | 35.2 |
| 14:37 | 87.2 | 1.36 | 1128 | −1711 | 41 | 47.3 | 46.5 | 36.7 |
| 14:38 | 86.2 | 1.83 | 1362 | −1109 | 41.7 | 48.3 | 47.6 | 38.2 |
| 14:39 | 85.7 | 2.05 | 933 | −932 | 42.2 | 49.5 | 48.8 | 38.9 |
| 14:40 | 85.3 | 2.2 | 923 | −941 | 41 | 47.2 | 47.2 | 39.5 |
| 14:41 | 85.7 | 2.04 | 362 | −316 | 40.4 | 46 | 46.2 | 39.2 |
| 14:42 | 86.2 | 1.58 | 332 | −324 | 40.3 | 45.6 | 45.8 | 38.7 |
| 14:43 | 86.1 | 1.41 | 307 | −333 | 40.3 | 45.4 | 45.7 | 38.6 |
| 14:44 | 85.7 | 1.41 | 304 | −331 | 40.3 | 45.3 | 45.6 | 38.5 |
| 14:45 | 85 | 1.53 | 302 | −362 | 40.1 | 45.2 | 45.6 | 38.5 |
| 14:46 | 84.3 | 1.66 | 301 | −400 | 40.1 | 45.1 | 45.6 | 38.6 |
| 14:47 | 83.6 | 1.79 | 300 | −423 | 40.6 | 45.2 | 45.5 | 38.8 |
| 14:48 | 82.8 | 1.91 | 363 | −342 | 40.4 | 45.1 | 45.6 | 39 |
| 14:49 | 82.1 | 2.01 | 350 | −356 | 40.4 | 45 | 45.5 | 39.2 |
| 14:50 | 81.3 | 2.14 | 298 | −343 | 40.4 | 45.1 | 45.7 | 39.5 |
| 14:51 | 80.4 | 2.28 | 297 | −346 | 40.3 | 45.1 | 45.7 | 39.7 |
| 14:52 | 79.6 | 2.43 | 296 | −348 | 40 | 45.2 | 45.7 | 40 |
| 14:53 | 78.7 | 2.62 | 294 | −345 | 40.4 | 45.4 | 45.8 | 40.1 |
| 14:54 | 77.7 | 2.82 | 305 | −350 | 40.3 | 45.4 | 45.9 | 40.4 |
| 14:55 | 76.5 | 3.06 | 342 | −351 | 40.6 | 45.2 | 46.1 | 40.6 |
| 14:56 | 75.4 | 3.29 | 324 | −367 | 40.3 | 44.7 | 45.6 | 40.8 |
| 14:57 | 20.9 | 0.16 | 0 | 4 | 40 | 44 | 45.1 | 40.8 |

TABLE 4

Performance test result of 60 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 0:31 | 20.1 | 0.04 | 223 | 305 | 29 | 27.7 | 27 | 25.1 |
| 0:32 | 22 | 0.41 | 221 | −257 | 30.2 | 28.6 | 27.9 | 25.2 |
| 0:33 | 26.4 | 0.74 | 230 | −312 | 31.1 | 29.7 | 28.8 | 25.3 |
| 0:34 | 32 | 0.89 | 240 | −272 | 31.8 | 30.8 | 29.5 | 25.5 |
| 0:35 | 7.9 | 1.01 | 278 | −266 | 32.6 | 31.7 | 30.5 | 25.7 |
| 0:36 | 43.6 | 1.13 | 326 | −267 | 33.2 | 32.7 | 31.4 | 25.9 |
| 0:37 | 9.6 | 1.17 | 273 | −263 | 33.9 | 33.6 | 32.2 | 26.1 |
| 0:38 | 6.1 | 1.13 | 280 | −264 | 34.5 | 34.3 | 32.8 | 26.2 |
| 0:39 | 62.5 | 1.02 | 283 | −266 | 35.1 | 35.2 | 33.3 | 26.4 |
| 0:40 | 67.9 | 0.95 | 288 | −264 | 35.5 | 35.8 | 33.8 | 26.8 |
| 0:41 | 2.3 | 0.94 | 301 | −272 | 36.1 | 36.3 | 34.4 | 26.8 |
| 0:42 | 5.9 | 0.92 | 317 | −286 | 36.4 | 36.9 | 34.8 | 27.2 |
| 0:43 | 8.7 | 0.93 | 292 | −298 | 37 | 37.4 | 35.2 | 27.3 |
| 0:44 | 0.8 | 0.92 | 293 | −354 | 37.3 | 37.8 | 35.5 | 27.5 |
| 0:45 | 2.5 | 0.92 | 294 | −279 | 37.4 | 38.2 | 35.8 | 27.7 |
| 0:46 | 3.9 | 0.9 | 296 | −281 | 37.8 | 38.6 | 36.3 | 27.9 |
| 0:47 | 5.1 | 0.86 | 298 | −283 | 38.1 | 39.2 | 36.6 | 28.1 |
| 0:48 | 86 | 0.82 | 415 | −282 | 38.5 | 39.5 | 36.9 | 28.3 |
| 0:49 | 6.8 | 0.8 | 299 | −285 | 38.6 | 40 | 37.3 | 28.6 |
| 0:50 | 87.4 | 0.79 | 300 | −286 | 39 | 40.4 | 37.9 | 28.7 |
| 0:51 | 7.9 | 0.77 | 298 | −286 | 39.3 | 40.7 | 38.1 | 29 |
| 0:52 | 8.2 | 0.77 | 299 | −290 | 39.6 | 41 | 38.4 | 29.2 |
| 0:53 | 8.5 | 0.76 | 298 | −325 | 39.7 | 41.4 | 38.8 | 29.4 |
| 0:54 | 8.7 | 0.74 | 296 | −370 | 39.9 | 41.7 | 39.2 | 29.5 |
| 0:55 | 88.8 | 0.73 | 362 | −322 | 40 | 41.9 | 39.5 | 29.9 |
| 0:56 | 8.9 | 0.72 | 311 | −295 | 40.4 | 42.2 | 39.8 | 30.1 |
| 0:57 | 8.9 | 0.72 | 295 | −293 | 40.6 | 42.6 | 40 | 30.3 |
| 0:58 | 8.9 | 0.72 | 295 | −296 | 40.7 | 42.8 | 40.3 | 30.6 |
| 0:59 | 8.8 | 0.76 | 295 | −295 | 40.8 | 43.1 | 40.6 | 30.8 |
| 1:00 | 8.7 | 0.78 | 297 | −298 | 40.9 | 43.3 | 40.9 | 31.1 |
| 1:01 | 8.7 | 0.8 | 297 | −301 | 41 | 43.6 | 41.2 | 31.3 |
| 1:02 | 8.6 | 0.81 | 340 | −297 | 41.3 | 43.8 | 41.5 | 31.4 |
| 1:03 | 8.6 | 0.83 | 296 | −327 | 41.5 | 44.1 | 41.7 | 31.7 |
| 1:04 | 8.5 | 0.85 | 297 | −359 | 41.7 | 44.3 | 42 | 32 |

TABLE 4-continued

Performance test result of 60 min-type self-rescue device

| Protective Time (min) | $O_2$ Concentration (%) | $CO_2$ Concentration (%) | Expiration Resistance (Pa) | Inspiration Resistance (Pa) | Expired Gas Temperature (° C.) | Inspired Gas Temperature (° C.) | Dry Bulb Temperature (° C.) | Wet Bulb Temperature (° C.) |
|---|---|---|---|---|---|---|---|---|
| 1:05 | 8.4 | 0.87 | 297 | −383 | 41.7 | 44.5 | 42.2 | 32.2 |
| 1:06 | 8.3 | 0.89 | 298 | −316 | 42 | 44.7 | 42.4 | 32.4 |
| 1:07 | 8.2 | 0.9 | 301 | −311 | 42 | 44.8 | 42.6 | 32.6 |
| 1:08 | 8.1 | 0.92 | 372 | −308 | 42.2 | 45.1 | 42.7 | 32.8 |
| 1:09 | 88 | 0.93 | 328 | −308 | 42.2 | 45.1 | 42.8 | 33.1 |
| 1:10 | 7.8 | 0.94 | 296 | −306 | 42.3 | 45.2 | 43.1 | 33.3 |
| 1:11 | 7.7 | 0.96 | 296 | −309 | 42.3 | 45.4 | 43.1 | 33.4 |
| 1:12 | 7.5 | 0.96 | 296 | −311 | 42.3 | 45.6 | 43.4 | 33.6 |
| 1:13 | 7.4 | 0.98 | 295 | −317 | 42.4 | 45.6 | 43.5 | 33.8 |
| 1:14 | 7.2 | 1.01 | 294 | −346 | 42.5 | 45.7 | 43.7 | 34 |
| 1:15 | 87 | 1.03 | 336 | −389 | 42.6 | 45.7 | 43.6 | 34.2 |
| 1:16 | 6.8 | 1.06 | 929 | −485 | 42.4 | 45 | 43.1 | 34.2 |
| 1:17 | 6.6 | 1.11 | 979 | −998 | 46.5 | 50.8 | 47.4 | 34.8 |
| 1:18 | 5.5 | 1.45 | 1138 | −994 | 47.4 | 52 | 48.7 | 36 |
| 1:19 | 84.8 | 1.74 | 842 | −1112 | 47.9 | 53.2 | 49.7 | 36.8 |
| 1:20 | 4.4 | 1.85 | 842 | −1193 | 48.6 | 54.1 | 50.7 | 38.6 |
| 1:21 | 4.1 | 1.91 | 843 | −1056 | 49 | 55 | 51.6 | 39 |
| 1:22 | 3.8 | 1.98 | 840 | −1010 | 46.3 | 51.9 | 49.7 | 39.6 |
| 1:23 | 3.7 | 2.1 | 284 | −330 | 44.9 | 50.4 | 48.7 | 40.1 |
| 1:24 | 3.9 | 1.85 | 280 | −328 | 44.5 | 49.7 | 48.1 | 39.7 |
| 1:25 | 3.8 | 1.57 | 276 | −331 | 44.3 | 49 | 47.7 | 39.5 |
| 1:26 | 3.2 | 1.49 | 306 | −332 | 44.4 | 48.8 | 47.4 | 39.2 |
| 1:27 | 2.5 | 1.49 | 298 | −335 | 44 | 48.6 | 47.2 | 39.2 |
| 1:28 | 1.7 | 1.52 | 270 | −394 | 44 | 48.4 | 47 | 39 |
| 1:29 | 0.9 | 1.55 | 270 | −388 | 44 | 48.2 | 47 | 39 |
| 1:30 | 0.1 | 1.6 | 283 | −338 | 44 | 48.2 | 47 | 39 |
| 1:31 | 9.1 | 1.65 | 267 | −332 | 44 | 48.1 | 46.8 | 39 |
| 1:32 | 8.1 | 1.73 | 266 | −334 | 44 | 48.1 | 46.9 | 39.2 |
| 1:33 | 77 | 1.82 | 308 | −336 | 44 | 47.9 | 46.8 | 39.2 |

It may be seen from the experimental data in Tables 1~4 that, the device of the invention can conform to the 30 min, 40 min, 50 min, 60 min-type self-rescue device and meet the requirement of oxygen concentration. No large fluctuation appears in the temperature of the breathed gas during the service time. At the same time, the breathing resistance and the like can meet the requirements.

Preferred embodiments of the invention have been described in detail above in conjunction with the drawings. However, the invention is not limited to the specific details of the above embodiments, various simple variations may be made to the technical solutions of the invention within the scope of technical ideas of the invention, and these simple variations all pertain to the protection scope of the invention.

Additionally, it should be noted that, each specific technical characteristics described in the above specific embodiments may be combined in any suitable mode in the case of no contradiction. In order to avoid unnecessary repetition, no further illustration will be given on various possible combinations.

In addition, various different embodiments of the invention may also be combined arbitrarily, so long as it does not depart from the concept of the invention. All these combinations should be regarded as the contents disclosed in the invention.

What is claimed is:

1. A chemical oxygen self-rescue device, comprising: a breathing assembly (1), an oxygen generating assembly (2) and a gas bag (3) sequentially communicated with each other, characterized in that: the oxygen generating assembly (2) comprises an oxygen generating agent tank (21), a gas discharge valve (23) and an oxygen candle (22), the gas discharge valve (23) is arranged on a component above an oxygen generating agent in the oxygen generating agent tank (21) and below a breathing end of the breathing assembly (1), and the opening and closing of the gas discharge valve (23) is controlled by the inflated volume of the gas bag (3);

a heat radiation assembly and the oxygen generating agent (213) are provided in the oxygen generating agent tank (21), the heat radiation assembly communicates the breathing assembly (1) with the oxygen generating agent tank (21), the heat radiation assembly divides the oxygen generating agent tank (21) into a plurality of accommodation spaces configured for loading the oxygen generating agent (213) and filtering and cooling the gas in the oxygen generating agent tank, wherein the gas discharge valve (23) comprises a valve body (231), a valve core (234), a valve seat (232), a spring (233) and a valve core pull-cord (237), wherein the valve body (231) communicates the oxygen generating agent tank (21) with the atmosphere, the valve seat (232) is movably provided in the valve body (231), the valve core (234) is restricted on the valve seat (232) by the spring (233) for blocking the valve body, and the valve core (234) is connect to an inner wall of the gas bag (3) via the valve core pull-cord (237).

2. The chemical oxygen self-rescue device according to claim 1, characterized in that: the gas discharge valve (23) comprises a valve body (231) and a valve core (234), the valve body (231) communicates the oxygen generating agent tank (21) with the atmosphere, and the valve core (234) is provided in the valve body (231), one end of the valve core (234) blocks an end of the valve body (231) communicating with the atmosphere, and the blocking area of the valve core (234) is less than a cross-sectional area of the valve body (231), and the other end of the valve core (234) is connected to the gas bag (3).

3. The chemical oxygen self-rescue device according to claim 1, characterized in that: the spring (233) is a spiral spring with a diameter enlarging gradually from an end part of the valve body (231) far away from the oxygen generating agent tank (21) to an end part of the valve body (231) close to the oxygen generating agent tank (21).

4. The chemical oxygen self-rescue device according to claim 1, characterized in that: the heat radiation assembly comprises a vent pipe (211) and a heat radiation frame (212), the vent pipe (211) communicates the breathing assembly (1) with the oxygen generating agent tank (21), the heat radiation frame (212) is provided in the oxygen generating agent tank (21), and the vent pipe (211) and the heat radiation frame (212) divide the oxygen generating agent tank (21) into a plurality of accommodation spaces for loading the oxygen generating agent (213).

5. The chemical oxygen self-rescue device according to claim 4, characterized in that: the heat radiation frame (212) comprises heat radiation plates provided at least crosswise, wherein the number of the heat radiation plates provided crosswise is at least two, and the intersection angle of adjacent heat radiation plates is 60~90°.

6. The chemical oxygen self-rescue device according to claim 5, characterized in that: the heat radiation plate comprises a ventilation limit frame (a), in which a plurality of heat radiation meshes (b) are provided stackedly.

7. The chemical oxygen self-rescue device according to claim 4, characterized in that: the vent pipe (211) comprises a connection pipe segment (2111) and a ventilation and heat-dissipation pipe segment (2112) provided from top to bottom, the connection pipe segment (2111) is configured to connect the breathing assembly (1) with the oxygen generating assembly (2), and the ventilation and heat-dissipation pipe segment (2112) is configured to filter and cool the gas passing through.

8. The chemical oxygen self-rescue device according to claim 1, characterized in that: the breathing assembly (1) comprises a mouth piece (12), a mouth piece radiator (13) and breathing hose (15) sequentially communicated with each other, wherein the mouth piece radiator (13) comprises a first vent (131), a heat radiation body (132), a heat radiation assembly (133) and a second vent (134), wherein the first vent (131) and the second vent (134) are provided on the heat radiation body (132), the mouth piece radiator (13) communicates with the mouth piece (12) and the breathing hose (15) via the first vent (131) and the second vent (134), and the heat radiation assembly (133) is embedded in the heat radiation body (132) for cooling the gas passing through.

9. The chemical oxygen self-rescue device according to claim 1, characterized in that: the oxygen generating agent tank (21) comprises a tank body (215), of which the cross section is an ellipse;

a sealing edge structure of the tank body (215) comprises a tank body cavity wall (2151), a sealing glue (2152) and a tank body bottom wall (2153), wherein the edge of the tank body bottom wall (2153) covers the edge of the tank body cavity wall (2151) and curls toward a mounting end of the breathing assembly (1), and the sealing glue (2152) is provided on a contact surface between the edge of the tank body cavity wall (2151) and the edge of the tank body bottom wall (2153).

* * * * *